US007316087B1

(12) United States Patent
Smith

(10) Patent No.: US 7,316,087 B1
(45) Date of Patent: Jan. 8, 2008

(54) WINDSHIELD WIPER FLAG HOLDER

(76) Inventor: Braxton W. Smith, 2605 Wade Ave., Raleigh, NC (US) 27607

( * ) Notice: Subject to any disclaimer, the term of this patent is extended or adjusted under 35 U.S.C. 154(b) by 61 days.

(21) Appl. No.: 10/935,997

(22) Filed: Sep. 8, 2004

Related U.S. Application Data

(63) Continuation-in-part of application No. 10/721,214, filed on Nov. 25, 2003, now abandoned.

(51) Int. Cl.
*G09F 21/04* (2006.01)

(52) U.S. Cl. ..... 40/591; 40/643; 40/660; 248/229.1

(58) Field of Classification Search ..... 40/643, 40/658, 660, 591; 248/475.1, 229.1, 229.14, 248/229.2, 229.24
See application file for complete search history.

(56) References Cited

U.S. PATENT DOCUMENTS 1,677,379 A * 7/1928 Annin ..... 248/538
1,780,060 A * 10/1930 Bluff ..... 24/567
1,787,150 A * 12/1930 Gerow et al.
3,612,460 A * 10/1971 Smith ..... 40/607.12
5,423,281 A * 6/1995 Crookham et al. ..... 116/173
5,463,973 A * 11/1995 Tait ..... 116/173
5,694,733 A * 12/1997 Gallemore, II ..... 52/736.2

* cited by examiner

*Primary Examiner*—Gary C. Hoge
(74) *Attorney, Agent, or Firm*—Coats & Bennett, P.L.L.C.

(57) ABSTRACT

A windshield wiper flag holder comprises a bracket that is securable to an outer face of a windshield wiper arm by a plurality of flexible locking ties. Extending at an acute angle from the plane of the bracket is a flag holder. The flag holder includes an elongated sleeve for receiving an elongated support associated with a flag. In one embodiment, the bracket and flag holder are of a single piece plastic construction. Further, a portion of the flag holder includes a fastening tab. A flag designed to be received and supported by the device can be provided with a flexible collar for snapping onto the fastening tab of the flag holder.

12 Claims, 4 Drawing Sheets

WINDSHIELD WIPER FLAG HOLDER

CROSS-REFERENCE TO RELATED APPLICATION

This is a continuation-in-part of U.S. patent application Ser. No. 10/721,214 filed Nov. 25, 2003 Now Abandoned. The disclosure of this application is expressly incorporated by reference.

FIELD OF THE INVENTION

The present invention relates to flags and to flag holders, and more particularly to a flag holder that is specifically designed to be detachably mounted to a windshield wiper arm such that when the flag holding device supports the flag and is attached to the windshield wiper arm, the flag is waved by the windshield wiper arm.

BACKGROUND OF THE INVENTION

Flag holding devices are well known. Over the years there has been a steady increase in the use of flag holders on vehicles. Much of this popularity is due to collegiate sports, especially football and basketball. Fans and alumni of educational institutions across this country purchase flag holders and flags that attach to their vehicles. On a sunny autumn day, for example, flags of almost all major universities can be seen flying on vehicles passing on the roads and streets in and around university campuses, towns and football stadiums.

For obvious reasons, today patriotism is perhaps more evident than at times in the past. This patriotism is often expressed by flying the United States flag. Here again, Americans have purchased flag holders and small United States flags that can be secured to a part of the vehicle such that as the vehicle moves along roads or streets, the United States flag flies.

One of the most popular flag holding devices is a clamp type structure that is disposed between a roll up window and the doorframe of a vehicle. Certainly these types of flag holders have enjoyed substantial success. However, the flag holder is always maintained stationary between the window and the doorframe. Thus, when the vehicle is stationary and there is no wind, the flag drapes and does not fly.

There has been and continues to be a need for a flag holding device that can be detachably secured to a vehicle, but which would impart motion to the flag independent of vehicle movement.

SUMMARY OF THE INVENTION

The present invention entails a windshield wiper flag-waving device that is detachably secured to a vehicle. Forming a part of the device of the present invention is a bracket adapted to be mounted adjacent the outer face of the windshield wiper arm. A flag holder extends from the bracket and includes an elongated sleeve for receiving the support of a flag. One or more fasteners engage the bracket and the windshield wiper arm and detachably connect the bracket to the windshield wiper arm. Thus, when attached to the windshield wiper arm, and when the flag holder of the device supports a flag, the actuation of the windshield wiper arm will result in the flag being waved.

In one particular embodiment of the present invention, the fasteners for securing the bracket to the windshield wiper arm comprise a series of flexible locking ties. These flexible tie locks wrap around the bracket and the windshield wiper arm and secure the bracket of the device to the windshield wiper arm.

In another embodiment, the present invention entails a windshield wiper arm in combination with a flag holding device. In this case the invention entails the windshield wiper arm, a bracket adapted to be mounted to the windshield wiper arm, a flag holder extending from the bracket, and one or more fasteners for detachably securing the bracket to the windshield wiper arm.

In another embodiment, the present invention includes a flag holding device that is adapted to be detachably mounted to a windshield wiper arm wherein the device comprises a molded one piece plastic construction including a base or bracket and a flag holder extending from the base or bracket. The flag holder is adapted to receive an elongated support associated with a flag to be supported by the device.

Other objects and advantages of the present invention will become apparent and obvious from a study of the following description and the accompanying drawings, which are merely illustrative of such invention.

DESCRIPTION OF EXEMPLARY EMBODIMENTS

Figure 1:
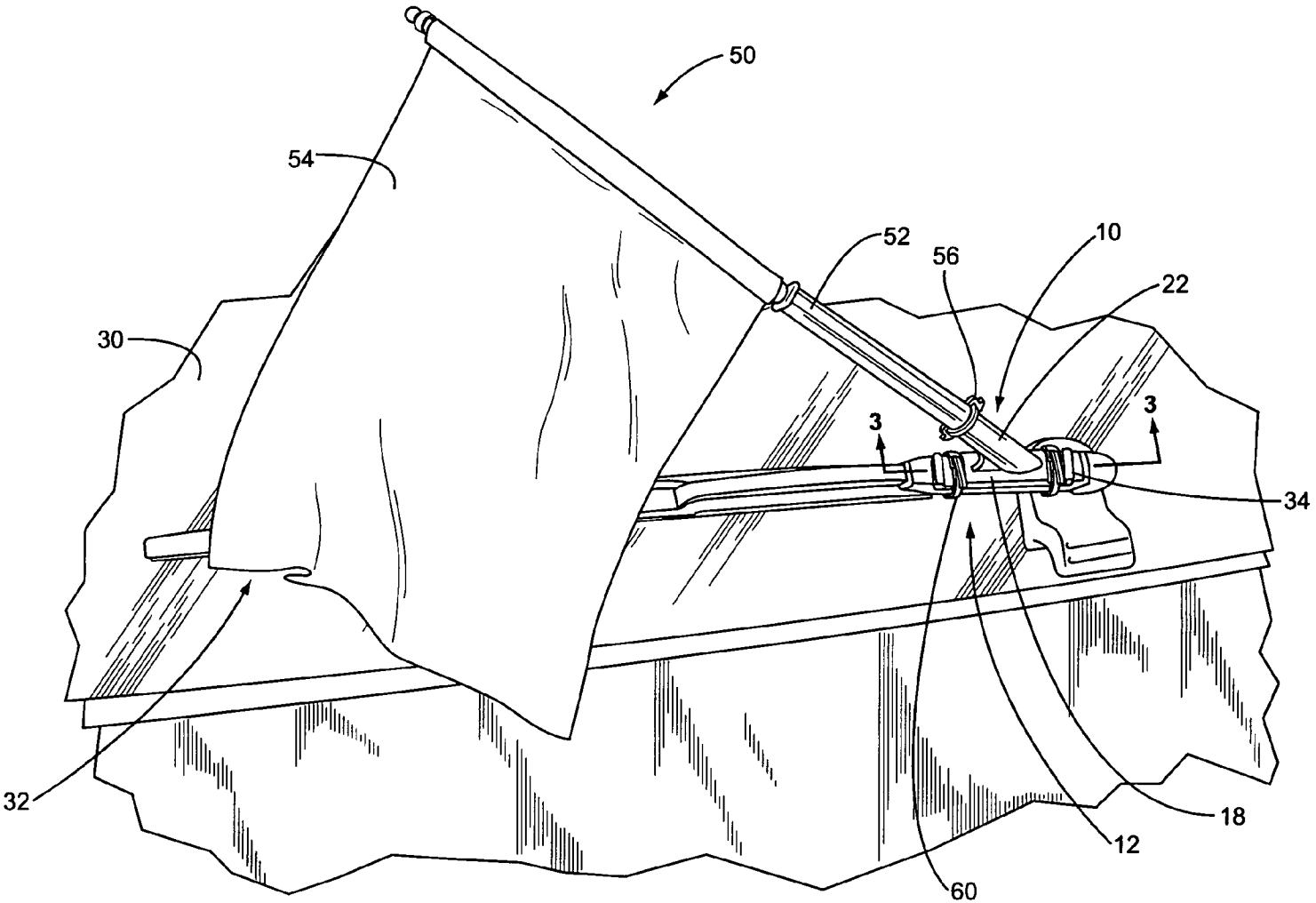
FIG. 1 is a perspective view of the flag holding device of the present invention shown mounted to a windshield wiper arm.
Figure 2:
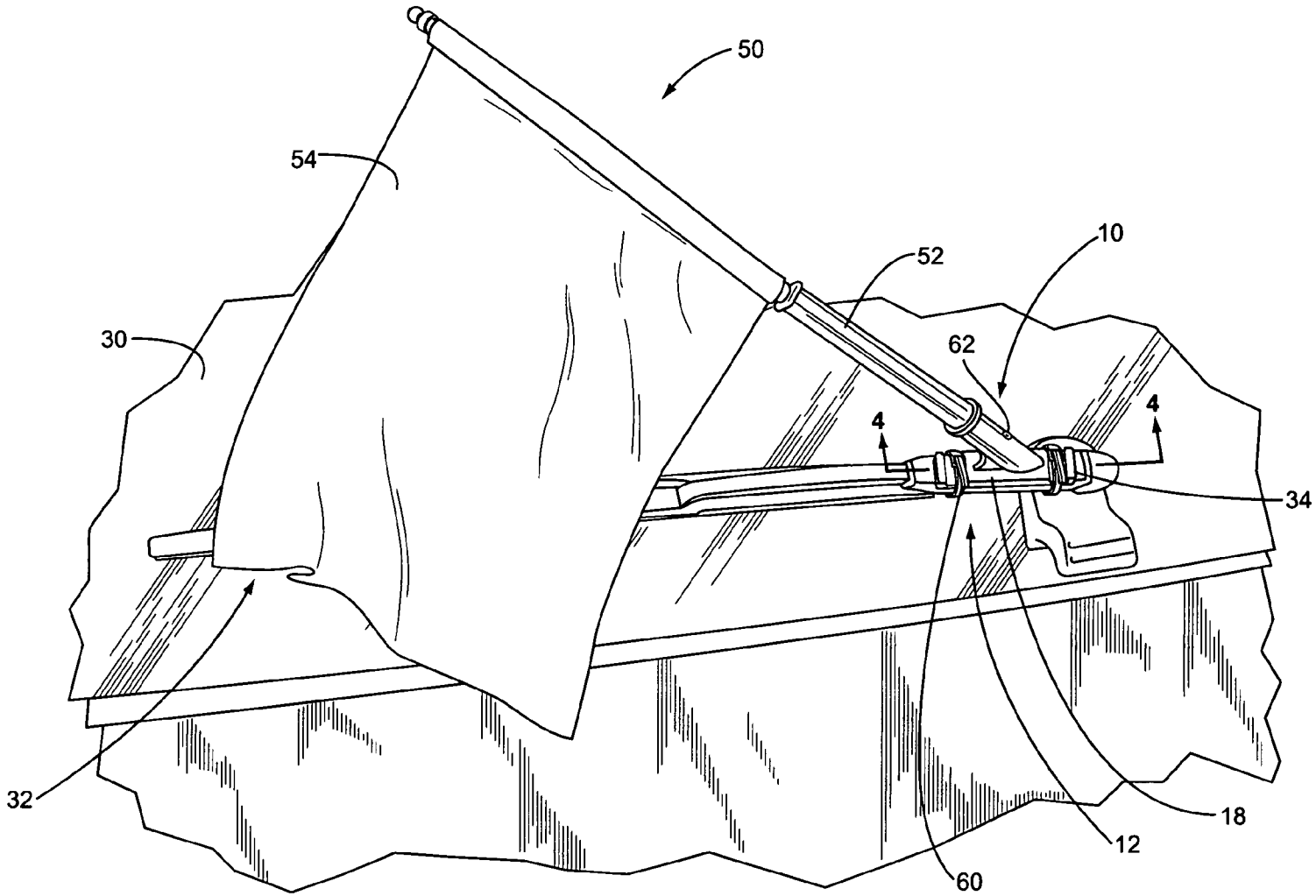
FIG. 2 is a perspective view similar to FIG. 1, but illustrating a second embodiment of the invention.

With further reference to the drawings, the windshield wiper flag holder of the present invention is shown therein and indicated generally by the numeral 10. As will be appreciated from subsequent portions of the disclosure, the windshield wiper flag holder 10 is designed to be detachably secured to the wiper arm 34 of a windshield wiper indicated generally by the numeral 32. In FIGS. 1 and 2, there is shown a windshield or glass panel 30. Windshield or glass panel 30 may constitute any type of glass panel that has a movable wiper associated therewith. For example, the windshield or glass panel 30 can be either a front, rear or side glass panel of any type of vehicle. As shown in FIGS. 1 and 2 windshield wiper 32 is secured by a bracket such that it extends over an exterior portion of the windshield or glass panel 30. In conventional fashion, windshield wiper 32 is driven such that it oscillates back and forth across the windshield or glass panel.

Turning to a more detailed discussion of the windshield wiper flag holder 10, the same comprises a bracket indicated generally by the numeral 12. Bracket 12 includes a lower portion or base 16 that includes a back surface. This back surface is designed to lay adjacent the outer face of the windshield wiper arm 34. That is, the back surface of the base 16 or the back surface of the bracket 12 would be positioned such that it would lie directly adjacent the outer face of the windshield wiper arm 34. Also, it is appreciated that some structure or device, such as a felt pad, could possibly be interposed between the bracket 12 and the outer face of the windshield wiper arm 34.

Further, bracket 12 includes an upper surface 18. Upper surface 18 includes a pair of transverse indentions 20 that extend across the upper surface of the bracket 12.

Extending outwardly from the bracket 12 is a flag holding structure. This flag holding structure includes a shaft 22. Shaft 22 forms a sleeve that includes a hollow portion 24 that is open at the top.

In the embodiment illustrated herein, bracket 12 and the flag holding structure, including the shaft 22, is of a one-piece construction. Although the flag holding device can be constructed of metal, wood, composites, etc. in one embodiment it is contemplated that the flag holding device would be of a single piece molded plastic construction.

Figure 4:
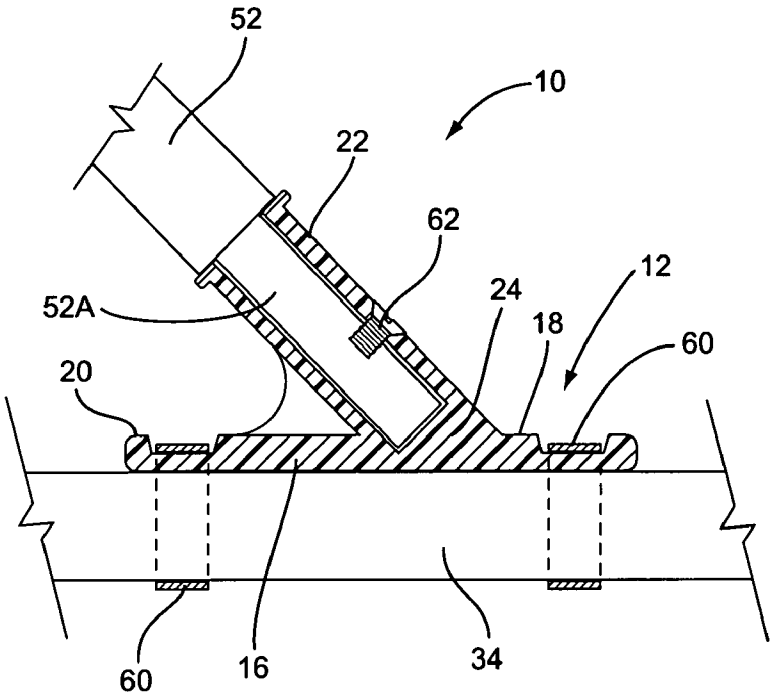
FIG. 4 is a cross sectional view taken through the line 4—4 of FIG. 2.
Figure 3:
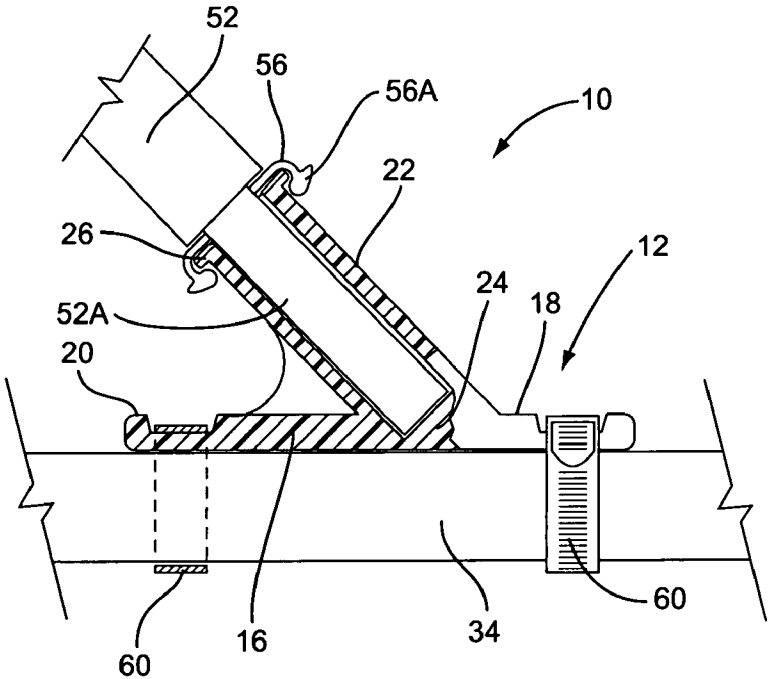
FIG. 3 is a cross sectional view taken through the line 3—3 of FIG. 1.

As discussed above, the flag holding device 10 is designed to be detachably secured to the windshield wiper arm 34. In order to provide for this function, there is provided one or more fasteners for fastening the bracket 12 to the windshield wiper arm 34. Although various types of fasteners can be employed, in the embodiment illustrated herein the fasteners utilized are in the form of flexible locking ties 60. Flexible locking ties are well known and appreciated in the art and a detailed discussion will not be set forth herein. Suffice to say that a flexible locking tie 60 is constructed of an elongated pliable and flexible plastic strip that includes a conventional locking device on one end that receives the other end of the tie. When the other end is threaded through the locking device the tie can be pulled taut and as the tie is pulled taut it progressively locks. The only practical way to remove the tie once it has been locked is to cut the flexible band that forms the tie. In any event, as illustrated in FIGS. 3 and 4, the flexible locking ties 60 are extended around the bracket 12 and around the wiper arm 34 and pulled taut and locked in place so as to securely station the bracket adjacent the wiper arm 34. Note that the flexible ties 60 are extended across the indentions 20 formed in the upper surface 18 of the bracket 12. This will securely station the flag holding device 10 on the windshield wiper arm 34.

Also shown in the drawings is a flag device indicated generally by the numeral 50. Flag device 50 includes an elongated support 52 that could be round, square, rectangular or any other shape. A flag or a sheet of pliable material 54 is secured to the support 52. As appreciated, the pliable material 54 would, in conventional fashion, include indicia, designs such as college names or logos, and the designs of national and state flags, etc.

The present invention proposes two approaches to securing the support 52 into the shaft 22 of the flag holder. In the embodiments illustrated in FIGS. 1 and 3, the support 52 of the flag includes an end stub portion 52A. Stub portion 52A is inserted into the open sleeve 24 formed by the shaft 22 of the flag holder. In the embodiment shown in FIGS. 1 and 3, the flag 50 is provided with a flexible attaching collar 56 that is disposed around the upper portion of the stub insert 52A just below the main portion of the support 52. The flexible attaching collar 56 includes a flexible rim 56A. When the flag 50 is inserted into the flag holder 10, the flexible attaching collar 56 simply snaps around the fastening tab 26 that is provided about the upper portion of the shaft 22. See FIG. 3, which shows the flexible attaching collar 56 closed around the fastening tab 26. Flag 50 can be easily removed by manipulating the rim 56A such that the fastening tab 26 associated with the flag holder can be pulled from the confines of the flexible retaining collar 56. Thus, in the embodiment shown in FIGS. 1 and 3, the flag 50 simply can be snapped into and snapped out of place with respect to the flag holder.

The second approach to securing the support 52 into the shaft 22 of the flag holder is shown in FIG. 4. Here the shaft 22 is provided with a setscrew opening. A setscrew 62 can be inserted through a threaded opening in the shaft such that the terminal end of the setscrew can engage and bear against the stub shaft 52A of the flag. This will securely anchor or hold the flag 50 within the flag holder.

Figure 5:
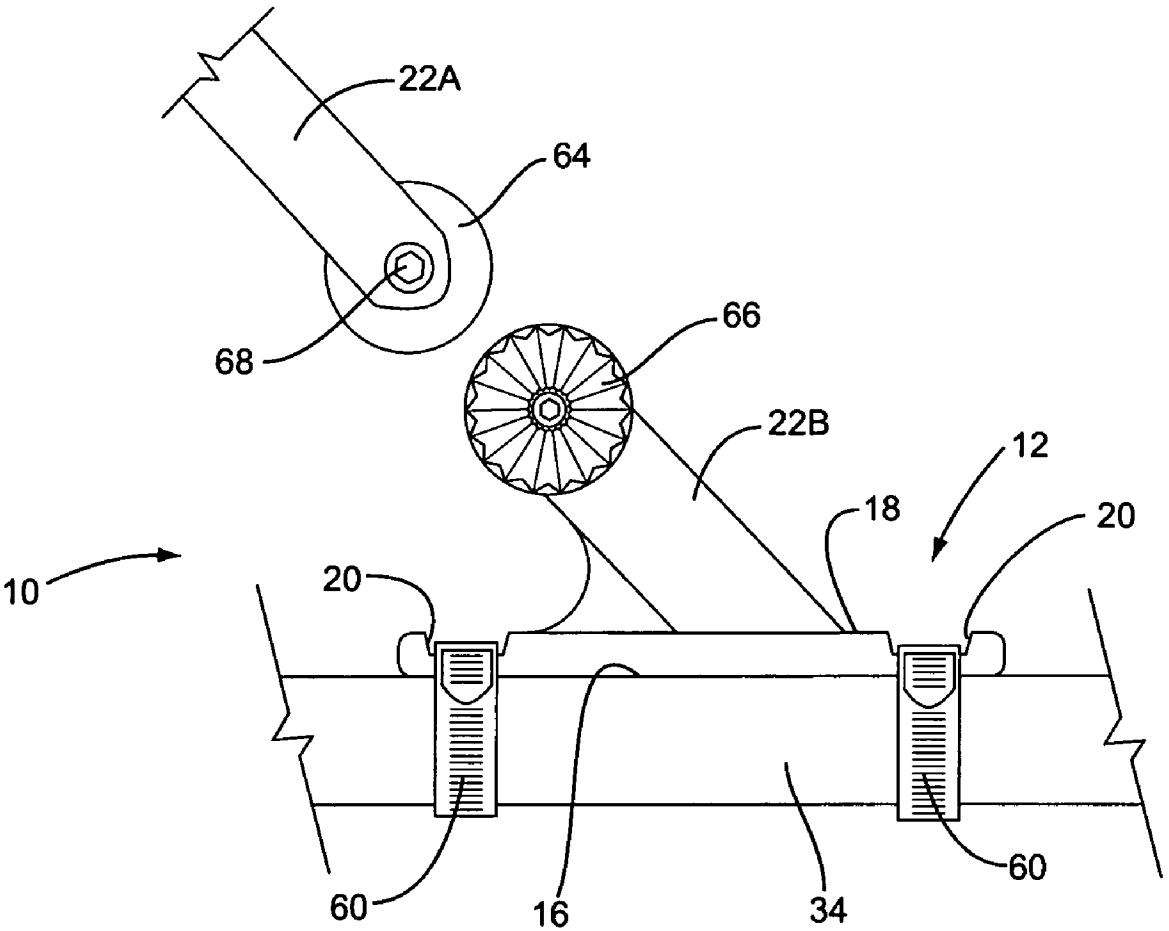
FIG. 5 is a perspective view illustrating a third embodiment of the present invention.

Turning to FIG. 5, there is shown therein an alternate embodiment for the flag holding device 10 of the present invention. In this alternate embodiment, the shaft of the flag holder includes two sections 22A and 22B. Sections 22A and 22B are movable with respect to each other. As illustrated in the drawings, sections 22A and 22B are pivotally connected together such that, for example, the upper section 22A can be pivotally adjusted with respect to the lower section 22B. That is, there is provided an angular adjustment mechanism interconnecting sections 22A and 22B. In the case of the design shown in FIG. 5, this angular adjustment mechanism includes two faces 64 and 66. Face 64 is integral or secured to the upper section 22A while the lower face 66B is integral or secured with the lower section 22B. Each of the faces 64 or 66 includes anti-rotation projections that extend upwardly from the respected faces. Thus, when the faces 64 and 66 are placed adjacent each other and the faces are locked together, the anti-rotation projections will generally prevent the faces from rotating with respect to each other. Each face 64 and 66 includes a central bore or opening. Extending through the central bore or opening is a locking bolt 68 that can be used with a nut to securely lock the faces 64 and 66 together.

Therefore, it is appreciated that when the flag holding device 10 is secured to a windshield wiper arm 34 that the angle of the flag support 52 can be adjusted in this case by adjusting the upper section 22A of the shaft with respect to the lower section 22B. That is, as viewed in FIG. 5, section 22A can be rotated clockwise or counterclockwise.

From the foregoing specification and discussion, it is appreciated that the present invention provides a flag holding device that is particularly designed to be secured to a windshield wiper arm of a vehicle. By securing the flag holding device to the windshield wiper arm, the windshield wipers of the vehicle can be actuated causing them to oscillate back and forth. As the windshield wiper oscillates back and forth, it follows that the flag holding device, being secured to the windshield wiper arm, is operative to move back and forth and to wave an attached flag in the process.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A windshield wiper flag waving device for detachably securing to the wiper arm of a windshield wiper, comprising:

a. a windshield wiper arm;

b. a bracket for laying adjacent an outer face of the windshield wiper arm;

c. a flag holder extending from the bracket and including a sleeve for receiving a support of a flag;

d. at least two flexible ties for extending around the bracket and the windshield wiper arm for detachably securing the bracket to the windshield wiper arm; and e. wherein when secured to the windshield wiper arm the bracket lies adjacent the windshield wiper arm and the flexible ties extend around the bracket and the windshield wiper arm and secure the bracket to the windshield wiper arm.

2. The windshield wiper flag waving device of claim 1 wherein the bracket and flag holder are of an integral molded plastic construction and wherein the sleeve of the flag holder includes an axis that extends at an acute angle with respect to the bracket; and wherein the bracket includes a back surface for engaging and resting outwardly of the windshield wiper arm.

3. The windshield wiper flag-waving device of claim 1 further including a flag having an elongated support and a pliable wavable material secured to the support.

4. The windshield wiper flag waving device of claim 3 wherein the flag holder includes a fastening tab that extends at least partially around a portion of the flag holder, and wherein the flag includes a flexible fastening collar that snaps around the fastening tab to secure the flag in the flag holder.

5. The windshield wiper flag waving device of claim 1 wherein the bracket includes an outer surface and a pair of flexible tie indentions extending across the outer surface for receiving the flexible ties where the flexible ties secure the bracket to the windshield wiper arm.

6. The windshield wiper flag waving device of claim 1 wherein the bracket includes an elongated member having a back surface for laying against an outer face of the windshield wiper arm, and an upper surface having a pair of spaced apart indentions for receiving the flexible ties; and wherein when the bracket is secured to the windshield wiper arm by the flexible ties extending around the bracket and the windshield wiper arm, the flexible ties extending through the indentions formed in the outer surface of the bracket.

7. The windshield wiper flag waving device of claim 1 wherein the flag holder includes an adjustment mechanism that permits a portion of the flag holder to be adjusted with respect to the bracket.

8. The windshield wiper flag waving device of claim 7 wherein the adjustment mechanism includes a rotating angular adjustment mechanism comprising first and second members that may be secured together, but also may be movably adjusted relative to each other.

9. The windshield wiper flag waving device of claim 1 wherein the flag holder includes at least two members connected by an angular adjustment mechanism.

10. The windshield wiper flag waving device of claim 9 wherein the angular adjustment mechanism includes two faces that can be rotated relative to each other and secured together in a plurality of different angular orientations.

11. The windshield wiper flag waving device of claim 10 wherein each face of the angular adjustment mechanism includes anti-rotation projections and wherein when the two faces are secured together the anti-rotation projections assist in preventing the faces from rotating relative to each other.

12. A windshield wiper flag waving device for detachably securing to the wiper arm of a windshield wiper, comprising:

a. a bracket for laying adjacent an outer face of the windshield wiper arm;

b. a flag holder extending from the bracket and including a sleeve for receiving a support of a flag;

c. at least two flexible ties for extending around the bracket and the windshield wiper arm for detachably securing the bracket to the windshield wiper arm.

d. a flag having an elongated support and a pliable wavable material secured to the support; and e. wherein the flag holder includes a fastening tab that extends at least partially around a portion of the flag holder, and wherein the flag includes a flexible fastening collar that snaps around the fastening tab to secure the flag in the flag holder.

* * * * *